US006349690B2

(12) United States Patent
Utsumi et al.

(10) Patent No.: US 6,349,690 B2
(45) Date of Patent: Feb. 26, 2002

(54) SUCTION APPARATUS FOR USE IN INTERNAL COMBUSTION ENGINE

(75) Inventors: Hajime Utsumi; Hiroshi Imaizumi, both of Hyogo (JP)

(73) Assignee: Tigers Polymer Corporation, Toyonaka (JP)

( * ) Notice: Subject to any disclaimer, the term of this patent is extended or adjusted under 35 U.S.C. 154(b) by 0 days.

(21) Appl. No.: 09/810,552

(22) Filed: Mar. 19, 2001

(30) Foreign Application Priority Data

Apr. 27, 2000 (JP) ..... 12-127330

(51) Int. Cl.[7] ..... F02M 35/02
(52) U.S. Cl. ..... 123/184.57
(58) Field of Search ..... 123/184.57, 184.56, 123/184.21, 198 E; 181/204; 55/385.3

(56) References Cited

U.S. PATENT DOCUMENTS 5,900,032 A * 5/1999 Wang ..... 55/385.3
6,067,953 A * 5/2000 Bloomer ..... 123/198 E
6,105,547 A * 8/2000 Sakamoto et al. ..... 123/184.57
6,217,627 B1 * 4/2001 Vyskocil et al. ..... 123/198 E

FOREIGN PATENT DOCUMENTS

JP 5891362-a * 5/1983 ..... 123/184.52

* cited by examiner

*Primary Examiner*—Marguerite McMahon
*Assistant Examiner*—Hyder Ali
(74) *Attorney, Agent, or Firm*—Oblon, Spivak, McClelland, Maier & Neustadt, P.C.

(57) ABSTRACT

The suction apparatus comprises an apparatus main body which is divided into lower and upper box bodies 11 and 15. In the apparatus main body, there are stored a first duct for sucking in air from the open air, a resonator connected to the first duct, a cleaner for cleaning the sucked-in air, and a second duct 30 for sending out the air, after it has passed through the cleaner, into the internal combustion engine. A plurality of ribs 19*a*, which are situated in the suction openings 30*a* of the second duct 30 and are used to reinforce the upper box body 15, are respectively inclined at an angle conformed to the installation angle θ of the second duct 30, whereby the ribs 19*a* can contribute toward guiding the flow of the air.

4 Claims, 3 Drawing Sheets

SUCTION APPARATUS FOR USE IN INTERNAL COMBUSTION ENGINE

BACKGROUND OF THE INVENTION

The present invention relates to a suction apparatus for use in an internal combustion engine.

Conventionally, as a suction apparatus which is used to supply air to an engine of a car, there is proposed a suction apparatus comprising a case serving as an apparatus main body. In the apparatus main body, there are incorporated suction ducts, an air cleaner and a closed-container-shaped resonator. The air cleaner cleans air sucked therein from the open air. The closed-container-like resonator reduces noise caused in the air sucking operation. In this case, the suction ducts comprises a first duct for sucking in air from the open air and a second duct for discharging the sucked-air into the car engine after has been cleaned by the air cleaner.

By the way, to structure the suction apparatus in a compact size, preferably the apparatus main body may be divided into a lower box body and an upper box body, and the air cleaner may be held between the upper and lower box bodies. In this case, in order to reduce the weight of the upper and lower box bodies and enhance the rigidity thereof, especially, in order to be able to obtain a hold force for holding the air cleaner therebetween, it is necessary to provide a plurality of ribs in the upper and lowerbox bodies. Some of these ribs are situated in suction openings respectively formed in the second duct, which raises a problem that the flow resistance of the air is increased.

SUMMARY OF THE INVENTION

The present invention aims at eliminating the drawbacks found in the above-mentioned conventional suction apparatus. Accordingly, it is an object of the invention to provide a suction apparatus for use in an internal combustion engine which can reduce the flow resistance of the sucked-in air as much as possible without impairing the function of the ribs disposed in the box bodies.

In attaining the above object, according to the invention, there is provided a suction apparatus for use in an internal combustion engine, comprising an apparatus main body divided into a lower box body and an upper box body. The apparatus includes therein a first duct for sucking in air from the open air, a resonator connected to the first duct, an air cleaner for cleaning the air sucked by the first duct, and a second duct for supplying the air, after it has passed through the air cleaner, to an internal combustion engine. The resonator, first duct and air cleaner are respectively stored in the lower box body, while the second duct is stored in the upper box body. The air cleaner includes a packing which is formed of elastic material and disposed on the periphery thereof. The upper box body includes a plate-shaped portion for pressing against the packing of the air cleaner and a plurality of ribs respectively disposed in the plate-shaped portion, and, of these ribs, ribs situated in the suction openings of the second duct are respectively inclined at an angle conformed to the installation angle of the second duct.

The above-mentioned object can also be achieved by a suction apparatus for use in an internal combustion engine, according to the present invention, comprising:

an apparatus main body having a lower box body and an upper box body;

a first duct disposed in the lower box for sucking in air from the open air;

a resonator disposed in the lower box body and connected to the first duct;

an air cleaner disposed in the lower box body for cleaning the air sucked by the first duct, the air cleaner including a packing which is formed of an elastic material and is disposed on the periphery of the air cleaner;

a second duct disposed in the upper box body for supplying the air to an internal combustion engine through its suction opening after it has passed through the air cleaner, the second duct extending in a direction inclined at a predetermined installation angle relative to a lateral direction of the apparatus main body, wherein the upper box body includes, a plate-shaped portion for pressing against the packing of the air cleaner; and a plurality of ribs respectively disposed in the plate-shaped portion, and, of the plurality of ribs, ribs situated in the suction opening of the second duct are respectively inclined at an angle conformed to the predetermined installation angle of the second duct.

In the above-structured suction apparatus, the resonator, first duct and air cleaner as well as the second duct are compactly incorporated into the lower and upper box bodies respectively. Due to provision of the ribs in the plate-shaped portion for pressing against the packing, the air cleaner can be held with a required force. Also, since some of these ribs, which are situated in the suction openings of the second duct, are respectively inclined at an angle conformed to the installation angle of the second duct, the flow of the air from the air cleaner to the second duct can be made smooth, thereby being able to reduce the flow resistance of the air.

DETAILED DESCRIPTION OF THE PREFERRED EMBODIMENT

Now, description will be given below of an embodiment of a suction apparatus for use in an internal combustion engine according to the invention with reference to the accompanying drawings.

Figure 1:
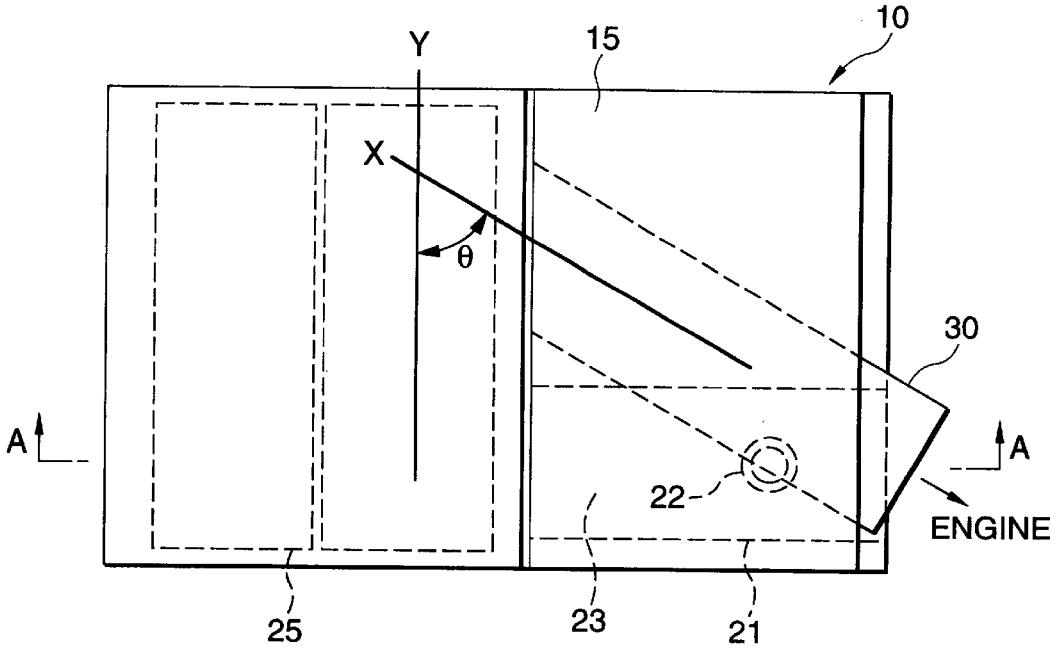
FIG. 1 is a plan view of a suction apparatus according to the invention.
Figure 2:
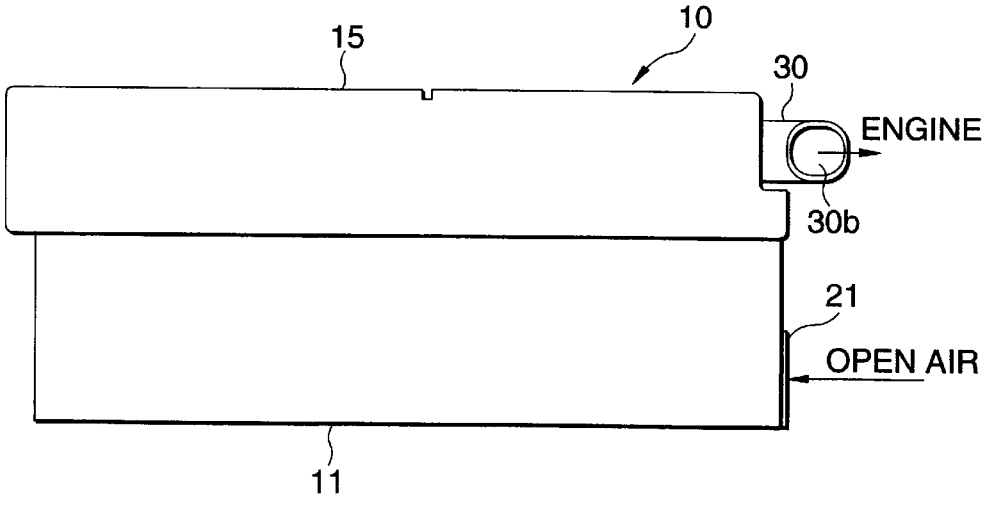
FIG. 2 is a front view of the above suction apparatus.
Figure 3:
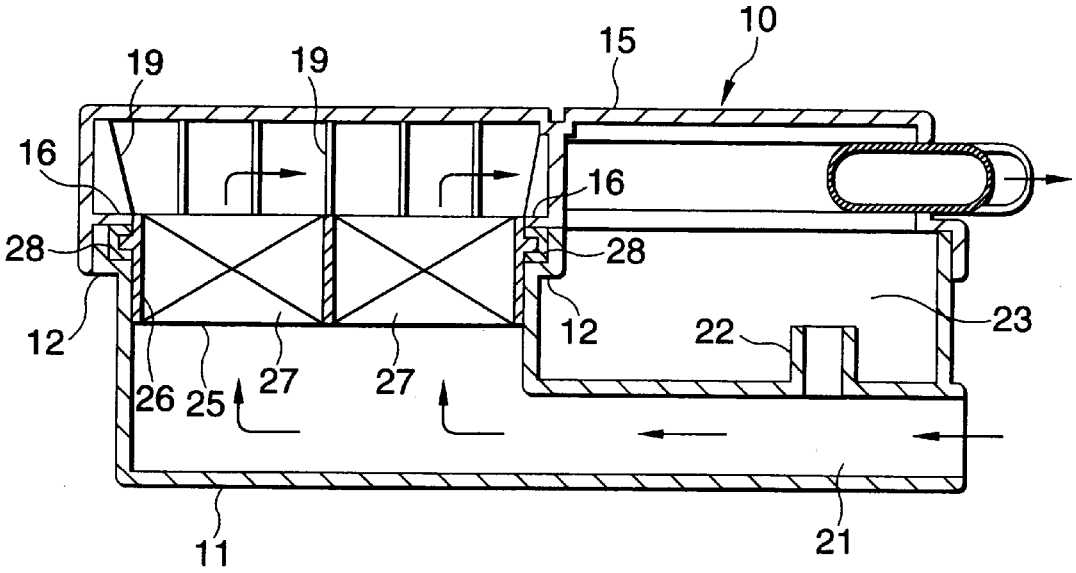
FIG. 3 is a section view taken along the line A-A shown in FIG. 1.

As shown in FIGS. 1 to 3, a suction apparatus main body 10 is divided into a lower box body 11 and an upper body 15. In the interior portion of the suction apparatus main body 10, there are stored a first duct 21, a resonator 23, an air cleaner 25 and a second duct 30. The first duct 21 functions for sucking in air from the open air. The resonator 23 is connected to the first duct 21 through a communication pipe 22 disposed in the first duct 21. The air cleaner 25 cleans the air sucked in by the first duct 21. The second duct 30 functions for discharging the cleaned-air sent from the air cleaner 25 into an internal combustion engine (not shown).

The resonator 23 and first duct 21 are respectively installed in the lower box body 11, while the air sucked in from the open air is supplied into the lower portion of the cleaner 25. The air cleaner 25 comprises a frame body 26 and air filters 27 respectively mounted on the frame body 26. On the periphery of the frame body 26, there are disposed packing 28 which is formed of elastic material (for example, elastomer). The air cleaner 25 is held by the stepped portion 12 of the lower box body 11 and is pressed by the plate-shaped portion 16 of the upper box body 15. That is, the air cleaner 25 is disposed in such a manner that the packing 28 is held by and between the stepped portion 12 of the lower box body and the plate-shaped portion 16 of the upper box body 15.

Figure 4:
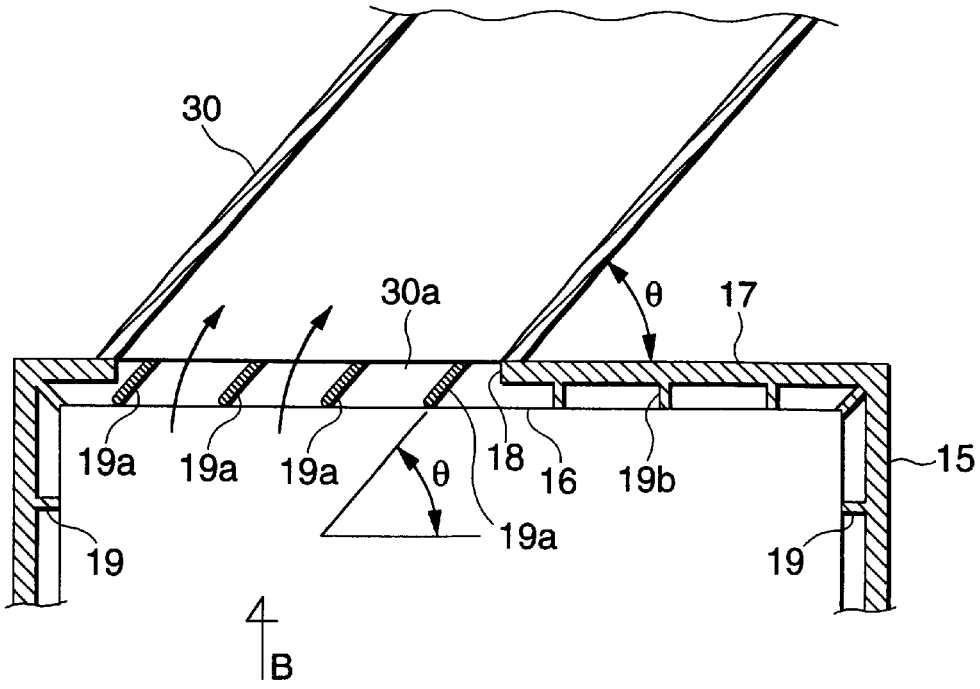
FIG. 4 is a section view of a horizontal surface relating to the main portions of the above suction apparatus.
Figure 5:
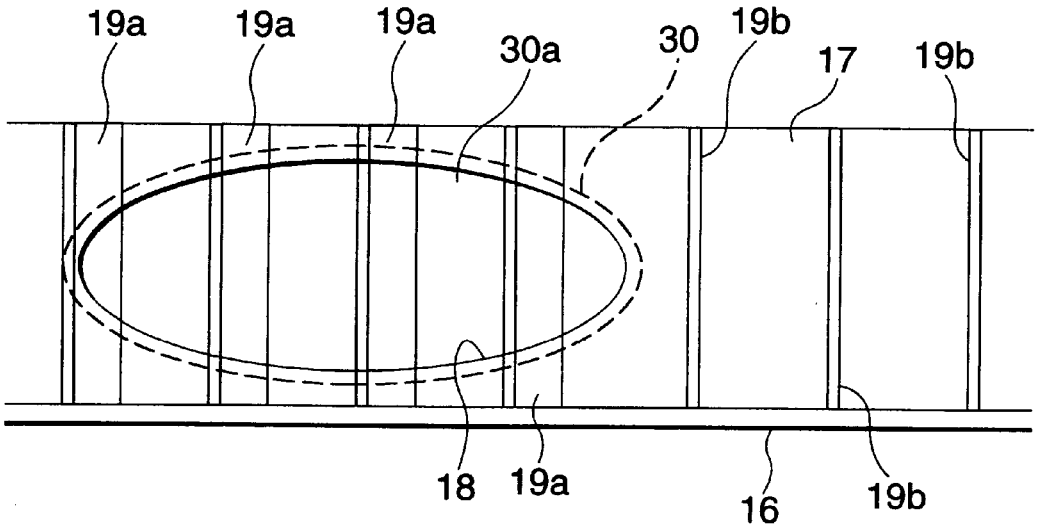
FIG. 5 is a view taken from the direction of the arrow mark B shown in FIG. 4.

The second duct 30 is stored in the upper box body 15 in such a manner that it is inclined at an angle of θ. In other words, an axis X of the second duct 30 extends in a direction inclined at a predetermined installation angle θ (of less than 90 degree) relative to a lateral direction Y of the apparatus main body 10 as shown in FIG. 1. The air that has passed through the cleaner 25 is introduced into the second duct 30 through a plurality of suction openings 30*a* (see FIG. 4) respectively formed in the second duct 30 and is then supplied into the internal combustion engine (not shown) of the car through a discharge opening 30*b* formed in the second duct 30. The upper box body 15 is separated by a wall portion 17, which is disposed in the central portion thereof, into two chambers in the right and left direction shown in FIG. 1, while the suction openings 30*a* of the second duct 30 respectively face an elliptic-shaped opening 18 formed in the wall portion 17 as shown in FIG. 5.

By the way, in the present embodiment, in the upper box body 15, at suitable portions thereof, there are disposed a plurality of ribs 19 in order to reduce the weights of the upper box body 15 as well as enhance the rigidity thereof. Especially, in the plate-shaped portion 16 which is used to press the packing of the air cleaner 25, in order to be able to secure a sufficient pressing force, there are disposed a plurality of ribs 19; and, of these ribs 19, the ribs 19*a* (see FIGS. 4 and 5), which are respectively situated in the suction openings 30*a* of the second duct 30, are inclined at an angle which is conformed to the installation angle θ of the second duct 30 relative to the wall portion 17 as shown in FIG. 4.

The flow angle of the air, when flowing into the second duct 30, is curved into the angle θ by the openings 30*a*. In this case, since the ribs 19*a* are set and inclined at angle θ, they can contribute a function for guiding the flow of the air. Assuming that the ribs 19*a* are disposed in parallel to their adjoining ribs 19*b*, they operate as the flow resistance of the air which is going to flow from the air cleaner 25 into the second duct 30. On the other hand, in the present embodiment, the ribs 19*a* operate as the flow guides of the air, so that the flow resistance of the air can be reduced greatly.

By the way, a suction apparatus according to the invention is not limited to the above-mentioned embodiment but various changes are possible without departing from the scope of the gist of the invention.

Especially, the structures of the details of the box bodies as well as the installation structures of the resonator and air cleaner can be selected arbitrarily. Also, the number of ribs to be situated in the suction openings of the second duct and the installation distance thereof can also be selected arbitrarily.

That is, while there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A suction apparatus for use in an internal combustion engine, comprising:

an apparatus main body having a lower box body and an upper box body;

a first duct disposed in said lower box for sucking in air from the open air;

a resonator disposed in said lower box body and connected to said first duct;

an air cleaner disposed in said lower box body for cleaning said air sucked by said first duct, said air cleaner including a packing which is formed of an elastic material and disposed on the periphery of said air cleaner;

a second duct disposed in said upper box body for supplying said air to an internal combustion engine through its suction opening after it has passed through said air cleaner, said second duct extending in a direction inclined at a predetermined installation angle relative to a lateral direction of said apparatus main body, wherein said upper box body includes, a plate-shaped portion for pressing against said packing of said air cleaner; and a plurality of ribs respectively disposed in said plate-shaped portion, and, of said plurality of ribs, ribs situated in the suction opening of said second duct are respectively inclined at an angle conformed to the predetermined installation angle of said second duct.

2. The suction apparatus according to claim 1, wherein said upper box body includes a wall member having an opening portion which faces said suction opening of said second duct, and said second duct extends at the predetermined installation angle relative to said wall member.

3. The suction apparatus according to claim 2, wherein said opening portion of said wall member is an ellipse-shaped opening.

4. The suction apparatus according to claim 1, wherein said predetermined installation angle is less than 90 degree.

* * * * *

UNITED STATES PATENT AND TRADEMARK OFFICE

CERTIFICATE OF CORRECTION

PATENT NO. : 6,349,690 B2
DATED : February 26, 2002
INVENTOR(S) : Utsumi et al.

It is certified that error appears in the above-identified patent and that said Letters Patent is hereby corrected as shown below:

Title page,
Item [30], the Foreign Application Priority information should read:
-- [30] Foreign Application Priority Data
April 27, 2000 (JP) ……. 2000-127330 --

Signed and Sealed this

Twenty-fourth Day of September, 2002

*Attest:*

*Attesting Officer*

JAMES E. ROGAN
*Director of the United States Patent and Trademark Office*